US011828255B2

(12) United States Patent
Grenz et al.

(10) Patent No.: US 11,828,255 B2
(45) Date of Patent: Nov. 28, 2023

(54) COMPONENT FOR AN INJECTION SYSTEM AND INJECTION SYSTEM FOR MIXTURE-COMPRESSING, SPARK-IGNITION INTERNAL COMBUSTION ENGINES AND METHOD FOR PRODUCING SUCH A COMPONENT

(71) Applicant: Robert Bosch GmbH, Stuttgart (DE)

(72) Inventors: Florian Grenz, Schwalbach (DE); Frank Schneider, Stelzenberg (DE); Goekhan Guengoer, Hemmingen (DE); Ralf Weber, Bretten (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 17/908,998

(22) PCT Filed: Jan. 21, 2021

(86) PCT No.: PCT/EP2021/051310
§ 371 (c)(1),
(2) Date: Sep. 2, 2022

(87) PCT Pub. No.: WO2021/180390
PCT Pub. Date: Sep. 16, 2021

(65) Prior Publication Data

US 2023/0099915 A1 Mar. 30, 2023

(30) Foreign Application Priority Data

Mar. 12, 2020 (DE) ..... 10 2020 203 174.6

(51) Int. Cl.
*F02M 55/02* (2006.01)
*F02M 61/16* (2006.01)

(52) U.S. Cl.
CPC ..... *F02M 55/025* (2013.01); *F02M 61/168* (2013.01); *F02M 2200/8069* (2013.01); *F02M 2200/9053* (2013.01)

(58) Field of Classification Search
CPC ..... F02M 55/025; F02M 61/168; F02M 2200/8068; F02M 2200/9053
(Continued)

(56) References Cited

U.S. PATENT DOCUMENTS

2002/0157231 A1 10/2002 Conrad
2018/0051664 A1 2/2018 Aul

FOREIGN PATENT DOCUMENTS

DE 102005048078 A1 4/2007
DE 102016211228 A1 12/2017
(Continued)

OTHER PUBLICATIONS

International Search Report for PCT/EP2021/051310, dated Mar. 18, 2021.

*Primary Examiner* — Hai H Huynh
(74) *Attorney, Agent, or Firm* — NORTON ROSE FULBRIGHT US LLP; Gerard Messina

(57) ABSTRACT

A component for an injection system for mixture-compressing, spark-ignition internal combustion engines, which is used to apportion a fluid under high pressure, in particular a high-pressure line or fluid manifold. The component includes a main body on which at least one hydraulic connection is provided, at least the main body having the connection being formed by single stage or multistage forging, an interior being formed on the main body by chip-removing machining after forging and a connection channel, which intersects with the interior in an intersection region, being formed at the connection by chip-removing machining after forging. The intersection region is deburred
(Continued)

by mechanical deburring. An injection system and a method for producing such a component are also described.

20 Claims, 3 Drawing Sheets

(58) Field of Classification Search
USPC ..... 123/456; 29/888.01
See application file for complete search history.

(56) References Cited

FOREIGN PATENT DOCUMENTS

| | | | | | |
|---|---|---|---|---|---|
| DE | 102016115550 | A1 | | 2/2018 | |
| DE | 102017111736 | A1 | | 12/2018 | |
| DE | 102020203650 | | * | 9/2021 | ..... F02M 55/02 |
| DE | 102020207472 | | * | 12/2021 | ..... F02M 55/02 |
| DE | 102020208759 | | * | 1/2022 | ..... F02M 55/02 |
| DE | 102020213168 | | * | 2/2022 | ..... F16L 3/02 |
| DE | 202020215193 | | * | 6/2022 | ..... F02M 61/14 |
| JP | H06198511 | A | | 7/1994 | |
| JP | 2010159676 | A | | 7/2010 | |
| JP | 2017186977 | A | | 10/2017 | |
| JP | 2018158372 | A | | 10/2018 | |
| WO | WO 2004020815 | | * | 3/2004 | ..... F02M 55/025 |
| WO | WO 2004070193 | | * | 8/2004 | ..... F02M 55/025 |
| WO | 2016042897 | A1 | | 3/2016 | |
| WO | WO 2021180390 | | * | 9/2021 | ..... F02M 55/025 |
| WO | WO 2022012940 | | * | 4/2022 | ..... F02M 55/02 |
| WO | WO 2022083934 | | * | 4/2022 | ..... F02M 55/025 |

* cited by examiner

COMPONENT FOR AN INJECTION SYSTEM AND INJECTION SYSTEM FOR MIXTURE-COMPRESSING, SPARK-IGNITION INTERNAL COMBUSTION ENGINES AND METHOD FOR PRODUCING SUCH A COMPONENT

FIELD

The present invention relates to a component, in particular a fuel line or a fuel manifold, for an injection system used for mixture-compressing, spark-ignition internal combustion engines. Specifically, the present invention relates to the field of motor vehicle injection systems, in which fuel is injected directly into combustion chambers of an internal combustion engine.

BACKGROUND INFORMATION

German Patent Application No. DE 10 2016 115 550 A1 describes a method for producing a fuel manifold, in which a manifold tube is produced from a forging blank in which austenitic steels with material numbers 1.4301, 1.4306, 1.4307 and 1.4404 can be used. It has been found in this connection that forging blanks exhibit production-related residual stresses from the forging process and that corrosion resistance is reduced by the formation of chromium carbides. In the conventional method, controlled heat treatment between 850° C. and 1100° C. for more than 60 seconds redissolves the chromium carbides produced by slow cooling. Mechanical properties and corrosion resistance are improved as a result. Since the heat treatment also improves machining characteristics for drilling, milling and thread cutting, it is preferably performed on the unmachined forging blank.

SUMMARY

A component according to the present invention, an injection system according to the present invention, and a method according to the present invention may have an advantage of enabling improved configuration and functionality.

The measures disclosed herein enable advantageous further developments of the component, the injection system, and the method.

The injection system according to the present invention is used for mixture-compressing, spark-ignition internal combustion engines. The injection system according to the present invention is used for injecting gasoline and/or ethanol and/or comparable fuels and/or for injecting a mixture including gasoline and/or ethanol and/or comparable fuels. A mixture may be, for example, a mixture including water. The component according to the present invention is used for such injection systems.

According to an example embodiment of the present invention, at least the main body of the component is formed from a material which is preferably a special steel, in particular an austenitic special steel. In particular, the material can be based on an austenitic special steel with the material number 1.4301 or 1.4307 or on a special steel comparable therewith. A hydraulic connection provided on the main body may take the form of a high-pressure inlet, high-pressure outlet or other high-pressure connection. During production, the main body is then preferably formed and further machined as a forging blank together with the high-pressure inlet and the at least one high-pressure outlet and, optionally, one or more other high-pressure connections.

A configuration of a fuel manifold according to an example embodiment of the present invention thus involves significant differences from a brazing rail, in which a tube for the brazing rail is machined and deburred before the attached components are brazed on. The forged configuration can in particular enable a higher pressure design. One significant difference from a high-pressure rail for compression-ignition internal combustion engines resides in the choice of materials and machining, in particular in the forging of a special steel. There are significant differences in contrast with electrochemical deburring (ECM deburring). ECM deburring requires a separate installation and a subsequent cleaning process which account for a not inconsiderable proportion of manufacturing costs. The mechanical deburring according to an example embodiment of the present invention, on the other hand, can straightforwardly follow on from a machining process and in particular be carried out in the same machining center. This applies in particular to the retraction deburring proposed according to an advantageous further development of the present invention, since one or more retraction deburrers can advantageously be integrated into the machining process. Thus, production can be simplified and unit costs reduced.

A further advantage of the mechanical deburring according to the present invention over ECM deburring is obtained with respect to a material state. In ECM deburring, excess material or at least one burr at a bore intersection is dissolved electrochemically, resulting in a material state which is practically free of compressive residual stress. In contrast, in one example configuration of the present invention, a material state under compressive residual stress may be obtained which exhibits higher cyclic strengths, in particular under pulsating internal pressure stress. This is obtained in particular in an advantageous further development as disclosed herein. It is thus advantageously possible to avoid an additional strength-enhancing process, such as for example autofrettage. Advantageous further developments of the present invention disclosed herein are particularly advantageous in this respect.

An advantageous further development of the present invention may enable an advantageous geometric configuration. In particular, advantageous deburring with a rotating deburring tool, in particular a retraction deburrer, is consequently possible.

Another example embodiment of the present invention enables an advantageous configuration of the main body with the hydraulic connection or connections. Mechanical deburring here enables reliable process control. For example, in ECM deburring, when an electrode is energized, contact between the electrode and a burr to be removed may result in a short circuit if the burr to be removed is too large, so bringing the process to a standstill without material removal. This problem arises in particular with the proposed austenitic special steels, since they are comparatively difficult to machine.

In particular, forging may give rise to actually unwanted microstructure constituents such as delta ferrite and deformation martensite. Reliable process control can also be achieved in this case by the proposed mechanical deburring. ECM deburring, on the other hand, could result in nonuniform material removal since dissolution behavior is dependent on microstructure. The mechanical deburring according to the present invention also avoids such disadvantages in an advantageous configuration disclosed herein.

Corresponding advantages are obtained in an advantageous further development of a method according to the present invention.

BRIEF DESCRIPTION OF THE DRAWINGS

Preferred exemplary embodiments of the present invention are explained in greater detail in the following description with reference to the figures, in which corresponding elements are provided with matching reference numbers.

DETAILED DESCRIPTION OF EXAMPLE EMBODIMENTS

Figure 1:
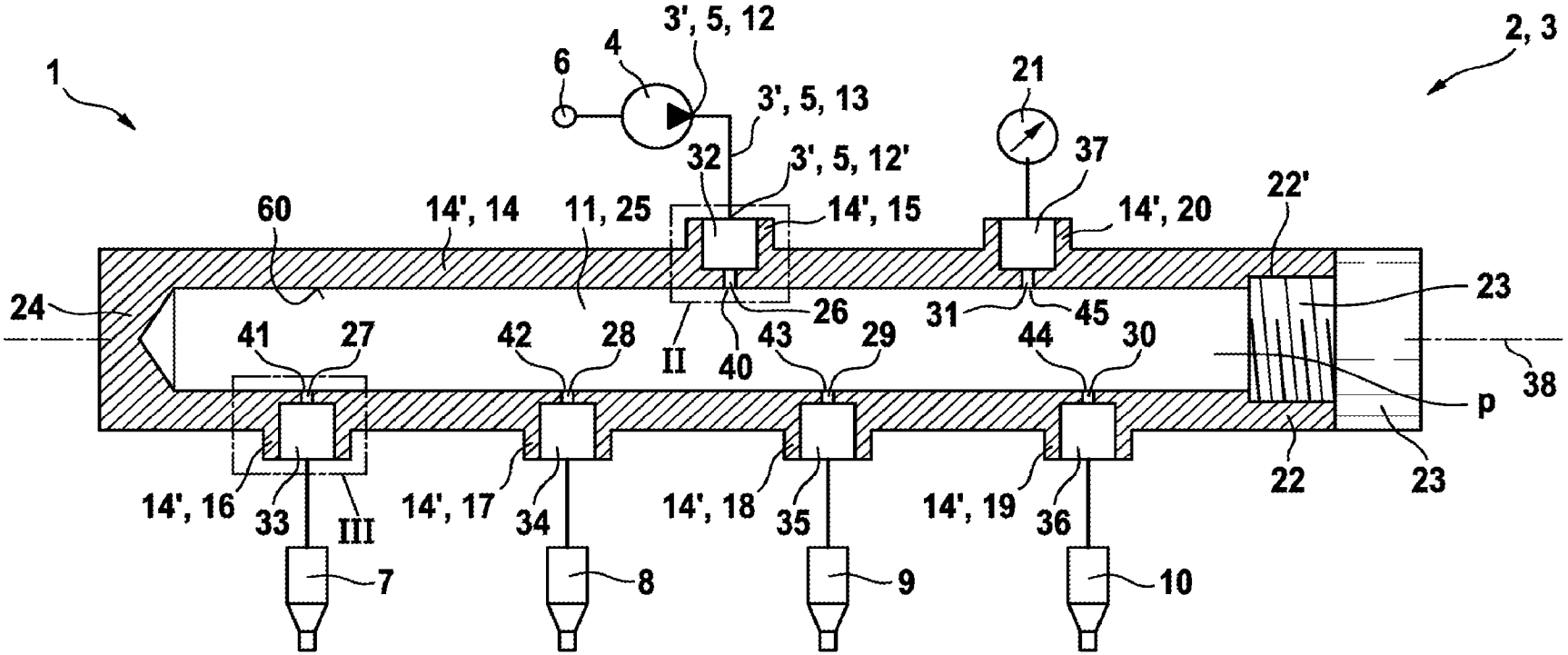
FIG. 1 shows an injection system for a mixture-compressing, spark-ignition internal combustion engine with a component in the form of a fuel manifold in a schematic sectional representation corresponding to one exemplary embodiment of the present invention.

FIG. 1 shows an injection system 1 with a fuel manifold (fluid manifold) 2 in a schematic sectional representation corresponding to one exemplary embodiment. In this exemplary embodiment, the fuel manifold 2 of the fuel injection system 1 is a component 3 configured according to the present invention. A high-pressure pump 4 is furthermore provided. The high-pressure pump 4 is connected to the fuel manifold 2 via a fuel line 5 configured as a high-pressure line 5. During operation, a fuel or a mixture including fuel is supplied as the fluid to an inlet 6 of the high-pressure pump 4. The high-pressure line 5 can correspondingly also be configured as component 3' according to the present invention.

The fuel manifold 2 is used for storing and distributing the fluid to injection valves 7 through 10 configured as fuel injection valves 7 through 10 and reduces pressure fluctuations and pulsations. The fuel manifold 2 can also be used to attenuate pressure pulsations that may arise during switching of the fuel injection valves 7 through 10. During operation, high pressures p may occur at least intermittently in an interior 11 of component 3. The high-pressure line 5 has hydraulic connections 12, 12' configured as high-pressure inlet 12 and high-pressure outlet 12', which can optionally be interchanged, and a main body 13.

The fuel manifold 2 has a tubular main body 14 which is formed by single stage or multistage forging. A hydraulic connection 15 configured as a high-pressure inlet 15 and a plurality of hydraulic connections 16 through 19 configured as high-pressure outlets 16 through 19 or cups 16 through 19 are provided on the tubular main body 14. A hydraulic connection 20 configured as a pressure sensor connection 20 is furthermore provided on the tubular main body 14. In this exemplary embodiment, the tubular main body 14, the high-pressure inlet 15, the high-pressure outlets 16 through 19 and the pressure sensor connection 20 are formed from a single forged part 14'. The high-pressure inlet 15, the high-pressure outlets 16 through 19 and the pressure sensor connection 20 are thus forged on the main body 14.

The fuel line 5 is connected at its high-pressure inlet 12 to the high-pressure pump 4 and at its high-pressure outlet 12' to the high-pressure inlet 15 of the fuel manifold 2. The fuel injection valves 7 through 10 are in each case connected to the high-pressure outlets 16 through 19 of the fuel distributor 2. A pressure sensor 21, which is connected to the pressure sensor connection 20, is furthermore provided. The tubular main body 14 is closed at one end 22 by a screw plug 23. In a modified configuration, an axial high-pressure inlet may be provided at one end 24 instead of the lateral and/or radial high-pressure inlet 15.

After forging, the tubular main body 14 or the individual forged part 14' is machined by at least one chip-removing machining operation. In this exemplary embodiment, after forging, a bore is additionally formed in the tubular main body 14 to form the interior 11. During operation, the fluid supplied to the high-pressure inlet 15 can be distributed via the interior 11 to the fuel injection valves 7 through 10 connected to the high-pressure outlets 16 through 19.

Bores 26 through 31 are moreover introduced into the individual forged part 14' by chip-removing machining. Bores 27 through 30 are here used for the high-pressure outlets 16 through 19. Bore 26 is used for the high-pressure inlet 15. Bore 31 is used for the pressure sensor connection 20. A thread 22' can furthermore be cut into the bore 25 at the end 22 of the main body 13.

Bores 32 through 37, which form connection chambers 32 through 37, can moreover be provided at the high-pressure inlet 15, the high-pressure outlets 16 through 19 and the pressure sensor connection 20. In this exemplary embodiment, the bore 25 is oriented axially with regard to a longitudinal axis 38. Bores 26 through 37 are oriented radially or radially eccentrically with regard to the longitudinal axis 38. In the case of a radial or radially eccentric orientation with regard to the longitudinal axis 38, it is then preferably possible, in the case of fastening for example in an engine compartment, to obtain an orientation of bores 26, 31, 32, 37 of connections 15, 20 or bores 27 through 30 and 33 through 36 of connections 16 through 19 above or below the longitudinal axis and/or from the longitudinal axis 38 which points away from or toward an engine.

Bores 26 through 31 form connection channels 26 through 31 which intersect with the interior 11. These connection channels 26 through 31 connect bores 32 through 37 to the interior 11. Bores 26 through 31 here intersect with the bore 25 which forms the interior 11. This results in intersection regions 40 through 45 on which burrs remain after chip-removing machining. The intersection regions 40 through 45 are deburred by mechanical deburring.

Figure 2:
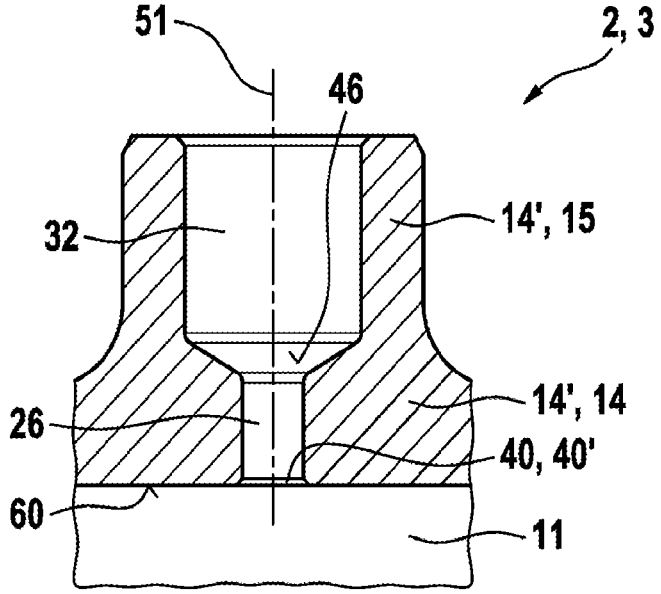
FIG. 2 shows the portion designated II in FIG. 1 of the component corresponding to the exemplary embodiment in a detailed, schematic representation, according to the present invention.

One possible configuration of connections 15, 20 is described by way of example on the basis of connection 15 and on the basis of FIG. 2. One possible configuration of connections 16 through 19 is described by way of example with reference to connection 16 on the basis of FIG. 3. One possible configuration for mechanical deburring is described on the basis of FIG. 4. This gives rise to one possible configuration of a component 3 which is configured according to an exemplary embodiment of the present invention. Another component 3' of the injection system 1, for example the high-pressure line 5, may also be correspondingly embodied, it being possible for connections 12, 12' to be correspondingly configured and mechanically deburred.

FIG. 2 shows the portion designated II in FIG. 1 of component 3 corresponding to the exemplary embodiment in a detailed, schematic representation. A conical and/or stepped transition 46 is provided between bores 26, 32 in this exemplary embodiment. Bores 26, 32 may here in particular be arranged coaxially. Depending on the application, a suitable thread can also be provided at the connection 15, for example for connecting the high-pressure line 5.

Figure 4:
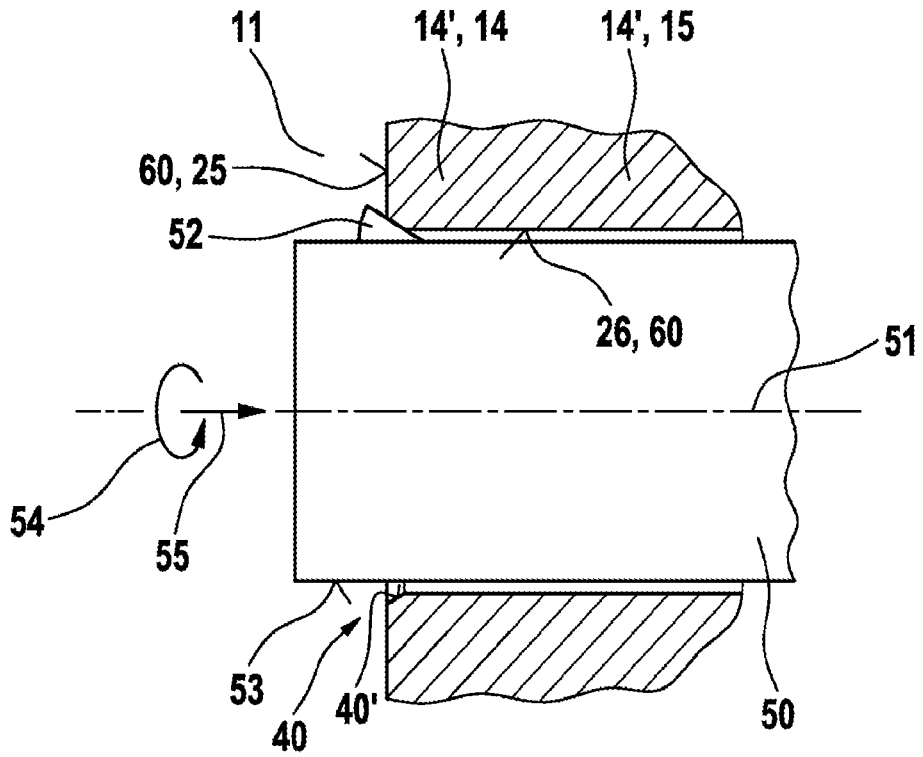
FIG. 4 shows a schematic representation of mechanical deburring of an intersection region to explain one possible example configuration of the present invention.

Deburring of the intersection region 40 may be carried out from the bore 32, as is also explained on the basis of FIG. 4. A chamfer 40' can be formed at the intersection region 40 as a result.

Figure 3:
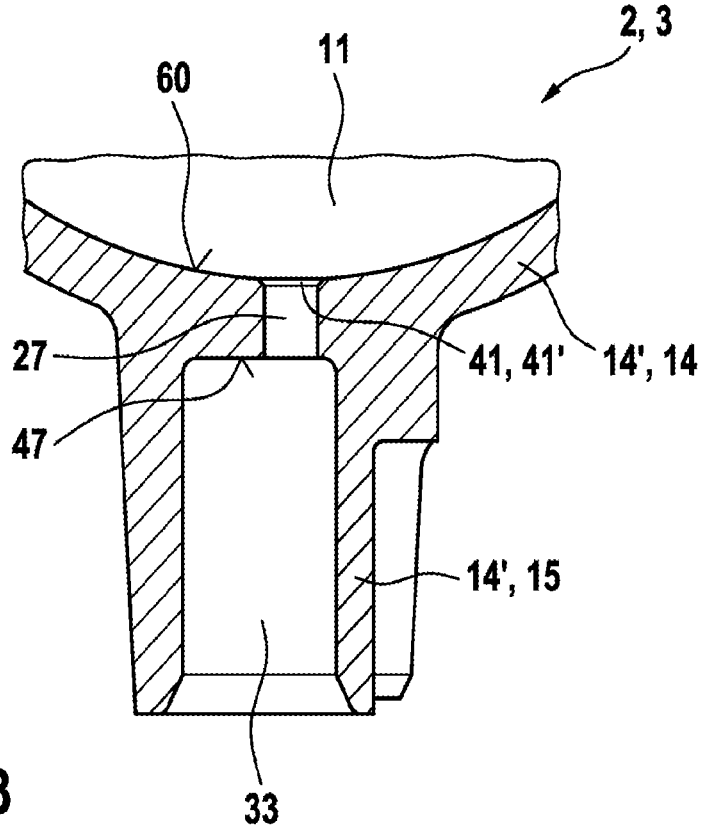
FIG. 3 shows the portion designated III in FIG. 1 of the component corresponding to the exemplary embodiment in a detailed, schematic representation in a section perpendicular to a longitudinal axis of the component.

FIG. 3 shows the portion designated III in FIG. 1 of the component 3 corresponding to the exemplary embodiment in a detailed, schematic representation in a section perpendicular to the longitudinal axis 38. In this exemplary embodiment, the bore 33 has a flat bore bottom 47, the bore 33 being arranged eccentrically relative to the bore 27. The bore 27 may here be oriented radially relative to the longitudinal axis 38. The bore 33 is then oriented radially eccentrically with regard to the longitudinal axis 38. Deburring of the intersection region 41 may be carried out from the bore 33, as is illustrated on the basis of FIG. 4. A chamfer 41' can be formed at the intersection region 41 as a result.

In this exemplary embodiment, the connection 15 can thus take the form of a valve cup 15.

FIGS. 2 and 3 illustrate options for implementing non-eccentric and eccentric connection geometries in which mechanical deburring can be carried out.

FIG. 4 shows a schematic representation of mechanical deburring of an intersection region 40 by means of retraction deburring tool 50 to explain a possible configuration of the present invention. The bores 25, 26 intersect with one another in the intersection region 40. The retraction deburring tool 50 can be inserted via the bore 32 (FIG. 2) along an axis 51. The retraction deburring tool 50 has at least one cutting edge 52. On insertion, the cutting edge 52 can be entirely or partially folded into a circumferential surface 53 of the retraction deburring tool 50. The cutting edge 52 can be folded out by rotation 54 and/or by application of a cutting fluid which can be supplied via the retraction deburring tool 50.

Retracting the retraction deburring tool 50 in a retraction direction 55 results in mechanical deburring of the intersection region 40 by way of the cutting edge 52 as a result of the rotation 54. Rotation 54 and/or the supplied liquid cutting fluid here applies the cutting edge 52 against the intersection region 40. The chamfer 40' can be formed in the process. The retraction deburring tool 50 can then be removed, the cutting edge 52 entirely or partially folding back into the circumferential surface 53.

Mechanical removal of a burr and chip-removing deedging can thus be achieved in the intersection region 40. Depending on the configuration of the retraction deburring tool 50, the cutting edge 52 may for example also be held in place by a spring in order to facilitate insertion and removal of the retraction deburring tool 50.

The time sequence of the chip-removing machining for configuring bores 25 through 37 can be implemented in a suitable manner. Mechanical deburring of intersection regions 40 through 45 can here be suitably integrated into or follow on from this machining.

In one possible implementation of the method, the bore 25 can firstly be drilled to provide the interior 11. Bores 32 through 37 for the connection geometries of connections 15 through 20 and bores 26 through 31 serving as connection channels 26 through 31 to the interior 11 can then be drilled. Mechanical deburring of the intersection regions 40 through 45 can then proceed. Mechanical deburring can thus follow on from the chip-removing machining.

In one possible embodiment of the method, once bore 25 for the interior 11 has been drilled, all the connection geometries are machined, in particular all bores 32 through 37 are drilled, then all bores 26 through 31 serving as connection channels 26 through 31 or connection bores 26 through 31 are drilled and finally all intersection regions 40 through 45 are mechanically deburred.

One possible modification of this method involves carrying out drilling and deburring in a different sequence which integrates deburring into the chip-removing machining. If a plurality of intersection regions 40 through 45 are mechanically deburred, a machining sequence may in each case relate to one of connections 15 through 20. This means, for example at connection 15, that bore 32 is drilled, then bore 26 is drilled and then the intersection region 40 is mechanically deburred. These steps can be carried out correspondingly in succession for each of connections 15 through 20.

Mechanical deburring thus does not necessarily proceed after completion of chip-removing machining. In particular, mechanical deburring can thus also be integrated into the chip-removing machining. By suitable process parameters and the selection of a suitable cutting fluid, it is also possible for an internal wall 60 extending, inter alia, from the bore 25 over the intersection region 40 and through the bore 26 to be provided with a material state under compressive residual stress. This internal wall 60 can also extend into the transition 46 (FIG. 2) or the bore bottom 47 (FIG. 3) and at least in part over bores 32 through 37. Provision of the internal wall 60 with the material state under compressive residual stress results in improved cyclic strength.

The present invention is not limited to the described exemplary embodiments.

What is claimed is:

1. A method of producing a component for an injection system for a mixture-compressing, spark-ignition internal combustion engine, the method comprising:

providing a main body with a hydraulic connection on the main body, wherein an interior of the main body intersects a first end of a connection channel of the hydraulic connection forming an intersection edge in an intersection region; and deburring the intersection region, wherein the deburring of the intersection region (I) is performed using a cutting edge of a mechanical deburring tool and (II) includes at least one of the following steps (a)-(c):

(a) retracting the mechanical deburring tool in a direction away from the interior of the main body and into the connection channel with the cutting edge of the mechanical deburring tool being arranged such that the cutting edge tapers radially outward from a first end of the cutting edge, which is arranged at a first axial position that is on a shaft of the mechanical deburring tool that is in the connection channel, to a second end of the cutting edge, which is at a second axial position that, while the deburring is performed, is more distal from a second end of the channel than the first axial position, the second end of the channel being opposite to the first end of the channel;

(b) spinning the mechanical deburring tool around a longitudinal axis of the mechanical deburring tool that is coaxial or parallel to a central longitudinal axis of the connection channel, by which spinning the cutting edge of the mechanical deburring tool moves rotationally along the intersection edge, which circumferentially surrounds the central longitudinal axis of the connection channel; and (c) (i) at least partially inserting the mechanical deburring tool through the connection channel in a first direction, with a first end of the mechanical deburring tool thereby entering into the interior of the main body via the connection channel, and (ii) subsequent to the insertion, retracting the mechanical deburring tool in a second direction opposite to the first direction, with the cutting edge of the mechanical deburring tool cutting the intersection edge during the retraction.

2. The method as recited in claim 1, wherein the component is a high-pressure line or fluid manifold.

3. The method as recited in claim 1, wherein a forged material of the main body is provided at an internal wall of the main body, which in operation is exposed to high pressure of fluid, with a material state under compressive residual stress.

4. The method as recited in claim 3, wherein; (i) the internal wall provided with the material state under compressive residual stress of the main body defines the interior, (ii) the internal wall provided with the material state under compressive residual stress of the main body extends over the intersection region, and/or (iii) the internal wall provided with the material state under compressive residual stress of the main body extends at least over the connection channel of the hydraulic connection.

5. The method as recited in claim 4, wherein: (i) the hydraulic connection has a connection chamber which is connected via the connection channel to the interior, and (ii) the internal wall provided with the material state under compressive residual stress extends from the connection channel at least in part over the connection chamber of the connection.

6. The method as recited in claim 1, wherein: (i) the interior of the main body is formed by at least one bore, and/or (ii) the connection channel is formed by at least one bore.

7. The method as recited in claim 1, wherein: (i) the main body and the at least one hydraulic connection are formed from a single forged part.

8. The method as recited in claim 1, wherein the injection system is for injecting a fluid which is at least one of a gasoline, ethanol, and a mixture including fuel.

9. The method as recited in claim 1, wherein:

the providing of the main body with the hydraulic connection includes performing the following steps:

forming the main body and at least one hydraulic connection by single stage or multistage forging; and forming the interior of the main body and the connection channel by chip-removing machining after the forging; and the deburring of the intersection region is performed after the interior of the main body and the connection channel are formed by the chip-removing machining.

10. The method as recited in claim 1, wherein the cutting edge, for the deburring, is applied against the intersection region by a liquid cutting fluid supplied for cooling during the deburring.

11. The method as recited in claim 9, further comprising:

supplying a liquid cutting fluid for cooling during the deburring;

at least intermittently placing the supplied liquid cutting fluid under such a high pressure that a forged material of the main body (a) is provided at an internal wall of the main body and (b) during operation of the injection system is exposed to high pressure of a fluid that is apportioned by the injection system with a material state under compressive residual stress.

12. The method as recited in claim 1, wherein the deburring of the intersection region includes the spinning of the mechanical deburring tool around the longitudinal axis of the mechanical deburring tool that is coaxial or parallel to the central longitudinal axis of the connection channel, by which spinning the cutting edge of the mechanical deburring tool moves rotationally along the intersection edge, which circumferentially surrounds the central longitudinal axis of the connection channel.

13. The method as recited in claim 12, wherein the intersection edge is a circumferential edge.

14. The method as recited in claim 1, wherein the deburring of the intersection region includes the (i) at least partially inserting the mechanical deburring tool through the connection channel in the first direction, with the first end of the mechanical deburring tool thereby entering into the interior of the main body via the connection channel, and (ii) subsequent to the insertion, the retracting of the mechanical deburring tool in the second direction opposite to the first direction, with the cutting edge of the mechanical deburring tool cutting the intersection edge during the retraction.

15. The method as recited in claim 14, wherein the deburring of the intersection region further includes the spinning of the mechanical deburring tool around the longitudinal axis of the mechanical deburring tool, by which spinning the cutting edge of the mechanical deburring tool moves rotationally along the intersection edge.

16. The method as recited in claim 14, wherein, during the at least partial insertion, the cutting edge is folded into a body of the mechanical deburring tool, and the method further comprises, between the at least partial insertion and the retraction, spreading the cutting edge radially outward.

17. The method as recited in claim 16, wherein, due to the spreading, the deburring is performed with the cutting edge of the mechanical deburring tool being arranged such that the cutting edge tapers radially outward from the first axial position of the mechanical deburring tool to the second axial position of the mechanical deburring tool, which, while the deburring is performed, is more distal from the second end of the channel than the first axial position, the second end of the channel being opposite to the first end of the channel.

18. The method as recited in claim 1, wherein the deburring includes the retracting of the mechanical deburring tool in a direction away from the interior of the main body and into the connection channel with the cutting edge of the mechanical deburring tool being arranged such that the cutting edge tapers radially outward from the first end of the cutting edge, which is arranged at the first axial position that is on the shaft of the mechanical deburring tool that is in the connection channel, to the second end of the cutting edge, which is at the second axial position that, while the deburring is performed, is more distal from the second end of the channel than the first axial position, the second end of the channel being opposite to the first end of the channel.

19. The method as recited in claim 1, wherein the main body is formed from an austenitic special steel.

20. The method as recited in claim 19, wherein the austenitic special steel has a material number of 1.4301 or 1.4307.

* * * * *